US006558217B1

(12) United States Patent
Jones

(10) Patent No.: US 6,558,217 B1
(45) Date of Patent: May 6, 2003

(54) MOUNTING AND RETRIEVAL SYSTEM FOR WAKEBOARDS AND THE LIKE

(76) Inventor: Scott Jones, 2355 N. Hwy. 360, Apartment 212, Grand Prairie, TX (US) 75050

( * ) Notice: Subject to any disclaimer, the term of this patent is extended or adjusted under 35 U.S.C. 154(b) by 0 days.

(21) Appl. No.: 09/499,256

(22) Filed: Feb. 7, 2000

(51) Int. Cl.[7] ..... B63B 35/85

(52) U.S. Cl. ..... 441/70; 441/74; 441/75; 114/39.19

(58) Field of Search ..... 441/70, 65, 68, 441/74, 75, 79; 114/39.19

(56) References Cited

U.S. PATENT DOCUMENTS 4,403,785 A * 9/1983 Hottel ..... 280/607
4,466,373 A * 8/1984 Prade et al. ..... 114/39.19
4,528,924 A * 7/1985 Marker et al. ..... 114/39.19
4,592,734 A * 6/1986 Metiver ..... 441/74
4,871,337 A * 10/1989 Harris ..... 441/74
4,938,725 A * 7/1990 Beck ..... 441/75
5,009,441 A * 4/1991 Toft ..... 441/74
5,018,468 A * 5/1991 Peterson ..... 441/75
5,021,017 A * 6/1991 Ott ..... 441/70
5,147,234 A * 9/1992 Brug ..... 441/70
5,484,312 A * 1/1996 Zepeda ..... 441/74
5,544,919 A * 8/1996 Tinkler ..... 441/75
5,558,552 A * 9/1996 Namur ..... 441/75
5,868,416 A * 2/1999 Fardie ..... 280/607
5,902,164 A * 5/1999 Shoemaker ..... 441/75
5,938,492 A * 8/1999 Carlini ..... 441/75
5,947,781 A * 9/1999 VonWald et al. ..... 441/70
6,007,394 A * 12/1999 Kagan ..... 441/74

* cited by examiner

*Primary Examiner*—S. Joseph Morano
*Assistant Examiner*—Lars A. Olson

(57) ABSTRACT

A mounting and retrieval system for wakeboards includes a pair of opposed pads for receiving the feet of a wakeboarder thereunder. The pads are mounted on subframes which facilitate the longitudinal and pivotal positioning of the pads. A strap extends over one of the pads to secure a foot of the wakeboarder while the opposite foot is being engaged with the opposing pad. A retrieval cable extends from a spring loaded reel mounted on one of the subframes which normally retracts the retrieval cable while facilitating extension thereof to facilitate a fall from the wakeboard.

7 Claims, 6 Drawing Sheets

MOUNTING AND RETRIEVAL SYSTEM FOR WAKEBOARDS AND THE LIKE

TECHNICAL FIELD

This invention relates generally to improvements in the art of wakeboard design and construction, and more particularly to a wakeboard mounting and retrieval system which is easier, safer, and more convenient to use as compared with the prior art.

BACKGROUND AND SUMMARY OF THE INVENTION

As is well known, the sport of surfboarding has been popular for decades, particularly in those parts of the world in which the ocean can be relied upon to regularly produce substantial waves. In general, surfboarding involves selecting a wave, mounting the surfboard as the wave approaches, and then riding the wave into the shore. More recently, the sport of snowboarding has gained popularity. In general, snowboarding involves mounting a snowboard, then riding it down a hill, ski jump, or the like in lieu of traditional skis.

Perhaps the most recent of the boarding sports is that of wakeboarding. As opposed to surfboarding and snowboarding wherein the power source is gravity, in wakeboarding the wakeboarder mounts the wakeboard and is then pulled by a power boat. The power boat also forms a wake which provides the wakeboarder with both an obstacle and an opportunity to perform stunts, etc.

Prior art mounting systems for wakeboards have involved the use of boots which in many ways resemble ski boots. Like a ski boot, prior art wakeboard boots have very securely received the boot, ankle, and lower leg of the wakeboarder. The wakeboard boots are secured to an aperture plate which is in turn secured to the wakeboard by threaded fasteners. The wakeboard plate has a plurality of apertures arranged in a generally circular array, thereby facilitating the positioning of the wakeboard boot in accordance with the preferences of a particular wakeboarder.

Although generally satisfactory, prior art wakeboard mounting systems have exhibited various problems. For example, although prior art wakeboard mounting systems perform adequately during wakeboarding, they have proven to be otherwise quite awkward. In particular, the use of threaded fasteners to secure the heavy and clumsy boot/aperture plate assembly to the wakeboard has made it impossible for the wakeboarder to reposition the wakeboard boots while in the water. Leaving the water, either by getting into the boat or by climbing onto a dock is both time consuming and disruptive.

Another problem involved in the use of prior art wakeboard mounting systems relates to safety. Prior art wakeboard boots are intended to protect the wakeboarder against ankle injury. In doing so, prior art wakeboard mounting systems present substantial difficulties to the wakeboarder in disengaging from the wakeboard in the event of a fall. Because the wakeboarder is locked onto the heavy wakeboard, swimming is virtually impossible, meaning that the wakeboarder may not be able to get out of the path of an oncoming boat and, in extreme cases, may be unable to avoid drowning.

Yet another problem which characterizes prior art wakeboard mounting systems comprises maintaining control over the wakeboard if the wakeboarder is able to disengage therefrom. The same problem applies to surfboards and snowboards, i.e., in the event of a fall, the board tends to float or slide away from its user with attempts at recovery only exacerbating the problem.

The present invention comprises a wakeboard mounting and retrieval system which overcomes the foregoing and other problems which have long since characterized the prior art. In accordance with the broader aspects of the invention, a wakeboard mounting and retrieval system includes a pair of opposed pads which are readily positionable relative to the wakeboard, both longitudinally and pivotally. In use, the pads extend over the feet of the wakeboarder who pushes outwardly against the pads, thereby gaining secure control over the wakeboard. If desired, a strap may be extended over one of the pads to facilitate maintaining control over the wakeboard during the actual mounting thereof by the wakeboarder.

In accordance with another aspect of the invention, a retrieval line is secured to the lower leg of the surfboarder by a strap. The retrieval line extends to a spring loaded reel which pays out the retrieval line in the event of a fall and which automatically rewinds the retrieval line when the wakeboard is re-mounted. As will be appreciated by those skilled in the art, the retrieval system of the present invention is equally adaptable to surfboards and snowboards.

BRIEF DESCRIPTION OF DRAWINGS

A more complete understanding of the invention may be had by reference to the following Detailed Description when taken in conjunction with the accompanying Drawings, wherein.

DETAILED DESCRIPTION

Figure 1:
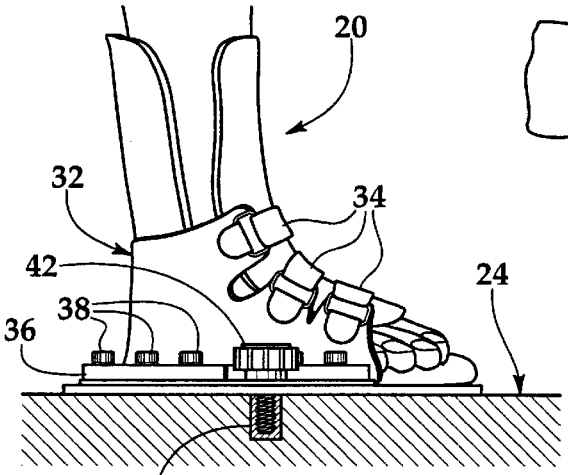
Fig.1 (PRIOR ART)
FIG. 1 is a side view of a prior art wakeboard mounting system.
Figure 2:
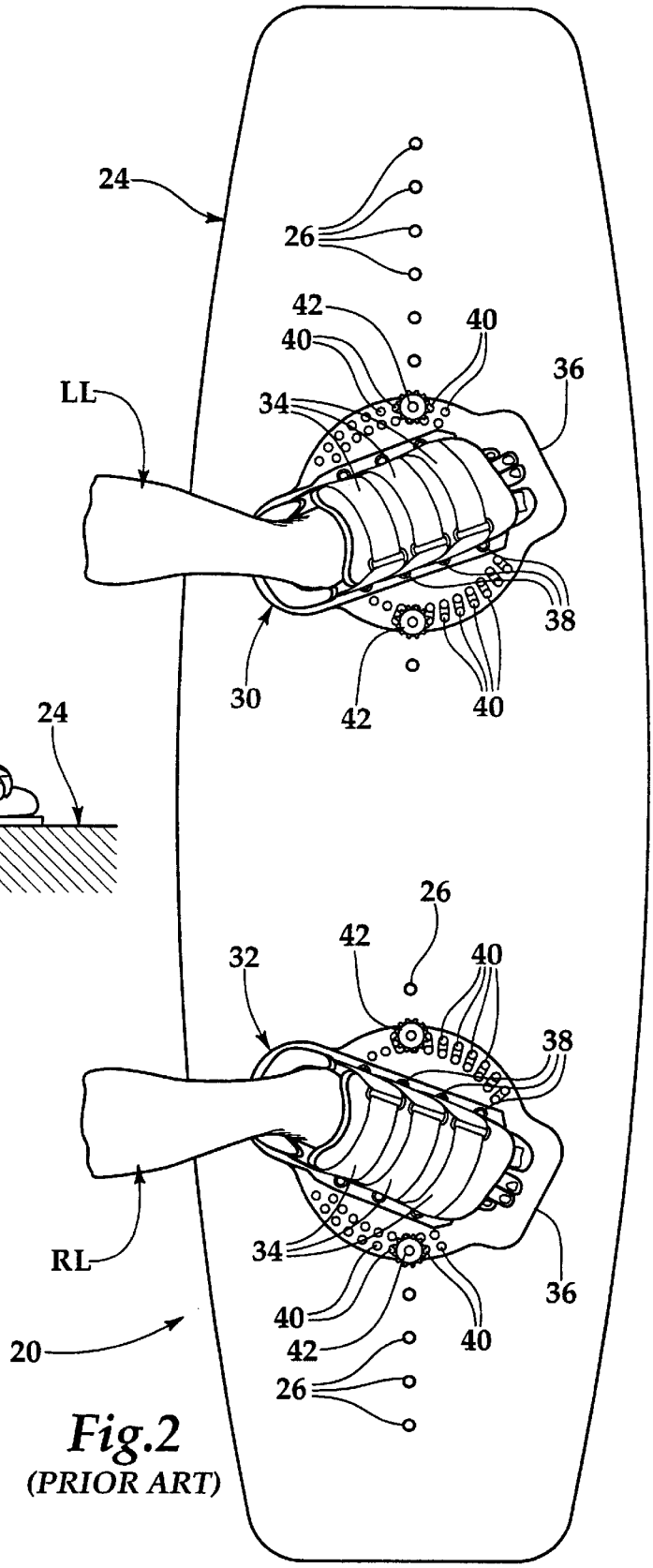
Fig.2 (PRIOR ART)
FIG. 2 is a top view of the prior art wakeboard mounting system of FIG. 1.

Referring now to the Drawings, and in particular to FIGS. 1 and 2 thereof, there is shown a prior art wakeboard mounting system 20. The system 20 is utilized in conjunction with a conventional wakeboard 24, it being understood that various types and kinds of wakeboards are known and used in the art. The wakeboard 24 is provided with a plurality of threaded apertures 26 which are located at spaced apart intervals along the longitudinal center line of the wakeboard 24.

The wakeboard mounting system 20 comprises a pair of boots 30 and 32 which are constructed from suitable plastic or other waterproof materials. The boots 30 and 32 are secured to the left leg LL and the right leg RL of a wakeboarder, respectively, by a plurality of straps 34 which are in turn secured in place by conventional fasteners. For example, the straps 34 may be secured in place by hook and loop-type fasteners of the type sold under the trademark "VELCRO"®.

The left and right boots 30 and 32 are secured to aperture plates 36 by threaded fasteners 38. The aperture plates 36 have a plurality of apertures 40 formed therethrough. As is clearly shown in FIG. 2, the apertures 40 of the aperture plates 38 are arranged in circular arrays. Threaded fasteners 42 extend through the apertures 40 and threadedly engage the threaded apertures 26 of the wakeboard 24.

It will therefore be understood that the aperture plates 36 are secured to the wakeboard 24 by threaded engagement of the fasteners 42 with the threaded apertures 26; the boots 30 and 32 are secured to the aperture plates 36 by the threaded fasteners 38; and the legs LL and RL of the surfboarder are secured in the boots 30 and 32, respectively, by the straps 34 and the fasteners thereof. In this manner the wakeboarder is very securely retained in engagement with the wakeboard with little possibility of separation between the two during wakeboarding activities.

Unfortunately, the secure connection between the wakeboarder and wakeboard also results in problems, for example, in the event of a fall. As will be appreciated by those skilled in the art, the wakeboard has considerable mass, as do the aperture plates and the boots which secure the wakeboarder to the wakeboard. So long as the mounting system secures the wakeboarder to the wakeboard, swimming is impossible which can lead to disastrous results such as injury or death.

The wakeboard mounting system of the prior art is also inconvenient to use. Because of the mass of the wakeboard, the aperture plates, and the boots comprising the prior art wakeboard mounting system, it is virtually impossible to remove the threaded fasteners 42, reposition one or both of the boots and the aperture plates secured thereto relative to the wakeboard, and re-engage the threaded fasteners with the threaded apertures of the wakeboard while the wakeboarder is in the water. This in turn means that in order to reposition the boots of the prior art wakeboard mounting system, the wakeboarder must leave the water either by climbing onto a boat or by climbing onto a dock. It is then possible to remove the fasteners 42, reposition one or both of the boots 30 and 32, and then re-engage the fastener 42 with selected threaded apertures 26 of the wakeboard 24, but only with considerable difficulty and loss of time.

Figure 3:
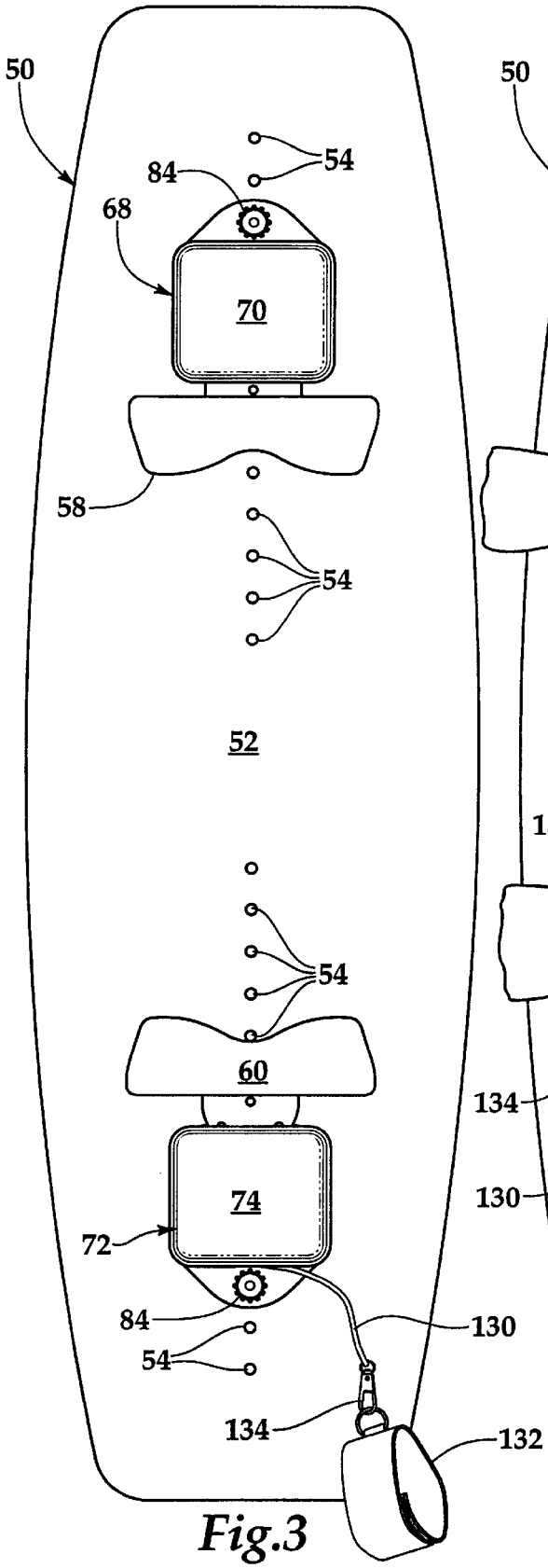
FIG. 3 is a top view of the wakeboard mounting and retrieval system of the present invention.
Figure 4:
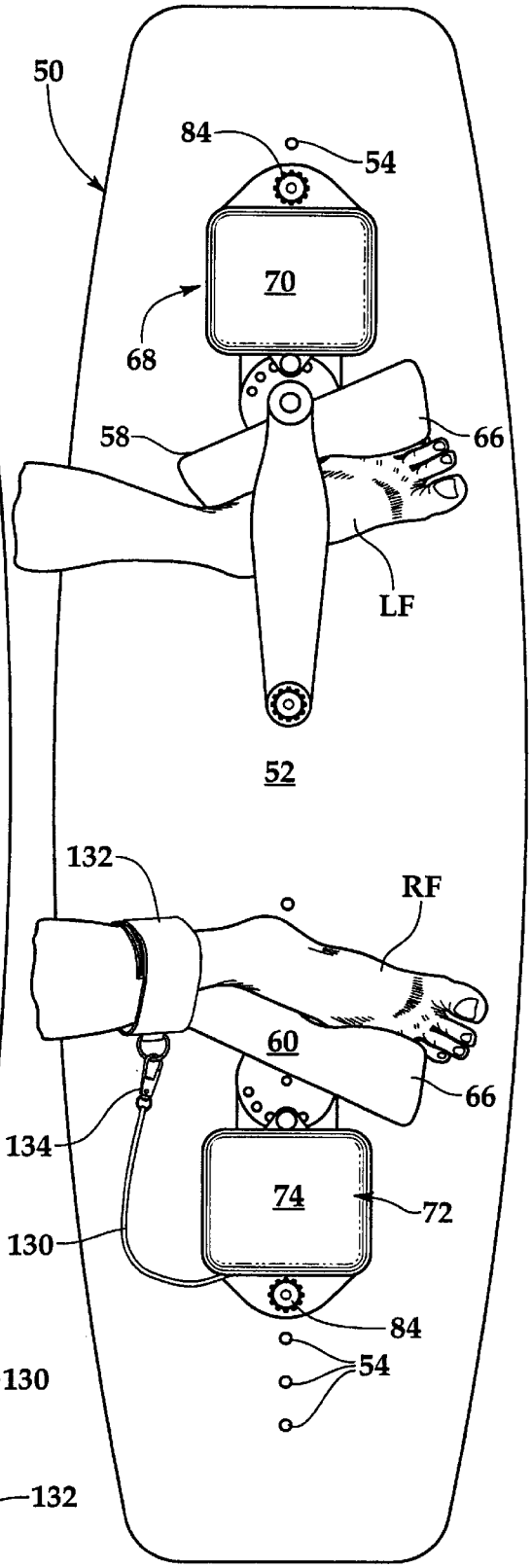
FIG. 4 is a top view similar to FIG. 3 illustrating the use of the wakeboard mounting and retrieval system of the present invention.
Figure 5:
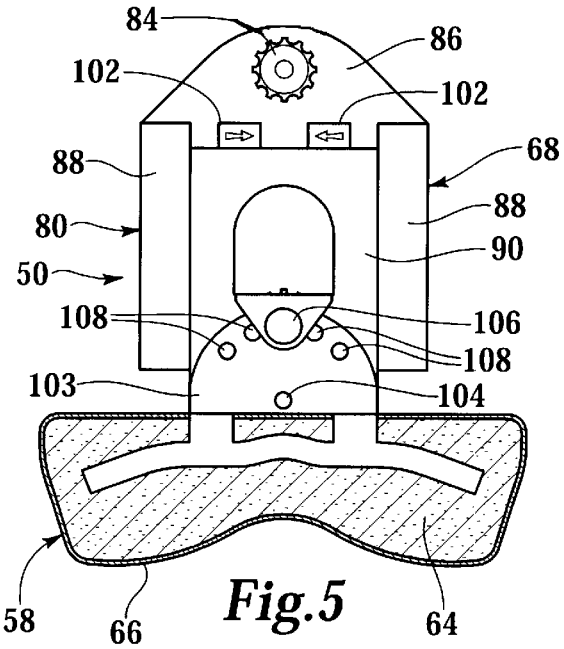
FIG. 5 is a somewhat enlarged partial top view of the front portion of the wakeboard mounting and retrieval system of FIG. 3.

Referring to FIGS. 3, 4, and 5 there is shown a wakeboard mounting and retrieval system 50 comprising the present invention. The wakeboard mounting and retrieval system 50 is utilized in conjunction with a conventional wakeboard 52 which is provided with a plurality of threaded apertures 54. As is well known to those skilled in the art, wakeboards such as the wakeboard 52 can be and are formed from a variety of materials including various woods, various types and kinds of plastics, various types and kinds of plastic foam having suitable coverings extending thereover, and various composite constructions. The threaded apertures 54 are shown in the conventional spaced apart array extending along the longitudinal axis of the wakeboard 52, however, other positionings of the threaded apertures 54 can be utilized in the practice of the invention.

The wakeboard mounting and retrieval system 52 includes a pair of opposed foot receiving pads 58 and 60 each comprising a rigid interior core or frame 62 formed from metal or plastic, a layer of resilient plastic foam 64 surrounding the core or frame 62, and a water impervious exterior layer 66 surrounding the foam 64. The pad 58 is supported by a subframe 68 which is protected by a cover 70 and which facilitates selective positioning of the pad 58 in the manner illustrated in FIG. 4. The pad 60 is mounted on a subframe 72 which is protected by a cover 74 and which likewise facilitates the selective positioning of the pad 60.

The use of the wakeboard mounting and retrieval system of the present invention is illustrated in FIG. 4. The left foot LF of the wakeboarder is positioned under the pad 58 and the right foot RF of the wakeboarder is positioned under the pad 60. The wakeboarder applies modest outward pressure against the pads 58 and 60 and is thereby securely retained and in engagement with the wakeboard 52. However, in the event of a fall, the feet of the wakeboarder are simply moved inwardly, whereupon the wakeboarder is instantly disengaged from the wakeboard 52 thereby completely eliminating the problems which can result if the wakeboarder remains engaged with the wakeboard.

Figure 7:
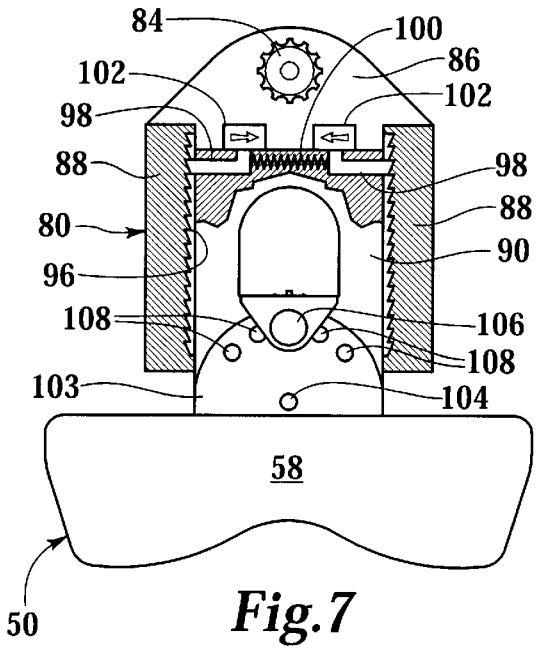
FIG. 7 is a view similar to FIG. 5 in which certain components have been broken away more clearly to illustrate certain features of the invention.
Figure 6:
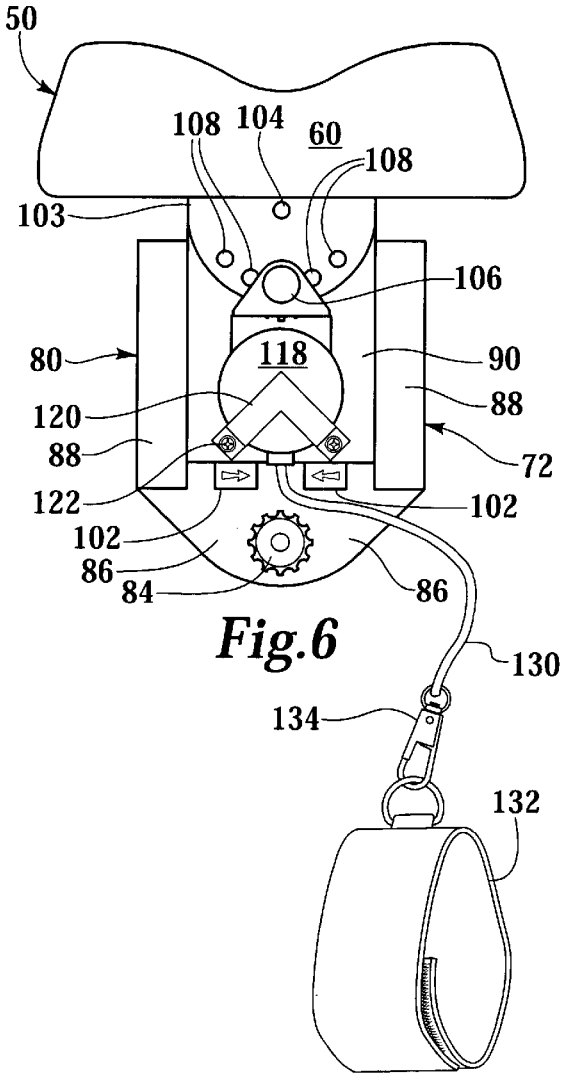
FIG. 6 is a somewhat enlarged partial top view of the rear portion of the wakeboard mounting and retrieval system of FIG. 3.
Figure 8:
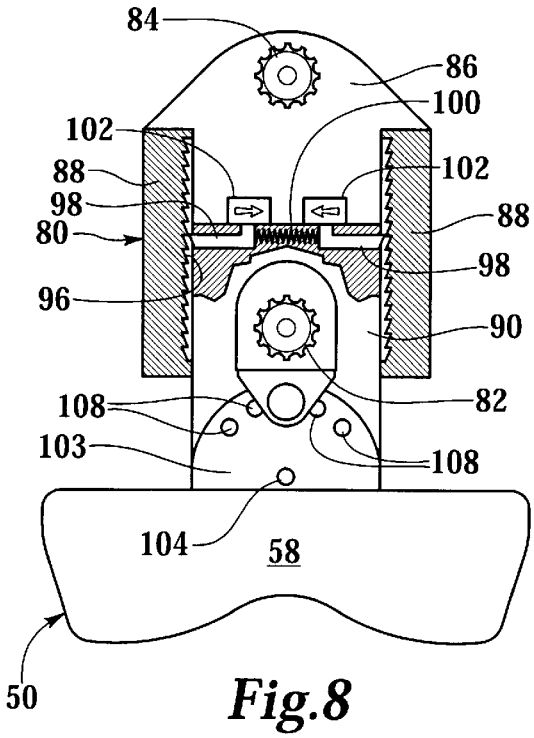
FIG. 8 is a view similar to FIG. 7 showing the component parts in a different configuration.

The construction and operation of the subframe 68 which supports and positions the pad 58 is illustrated in FIGS. 5, 7, and 8, it being understood that the construction and operation of the subframe 72 which positions the pad 60 is substantially identical. The subframe 68 includes a mounting bracket 80 which is secured to the wakeboard 52 by fasteners 82 and 84 which extend through apertures 86 formed in the bracket 80. The fasteners 82 and 84 comprise threaded fasteners which threadedly engage selected threaded apertures 54 formed in the wakeboard 52 to the secure the subframe 68 thereto.

The bracket 80 includes a pair of rails 88. A bracket 90 is slidably received between the rails 88. Referring particularly to FIGS. 7 and 8, the rails 88 have rachet teeth 96 formed on the interior surfaces thereof. The bracket 90 has opposed detents 98 slidably supported therein. The detents 98 are biased outwardly by a spring 100. Each detent 98 has a handle 102 secured thereto.

It will therefore be understood that the detents 98 are normally engaged with the rachet teeth 96 thereby preventing the pad 58 from moving outwardly, that is, toward the mounting bracket 80. Conversely, the pad 58 is easily moved inwardly, that is, away from the mounting bracket 80 by simply applying sufficient force thereto to overcome the resistence of the spring 100. Additionally, by moving the handles 102 inwardly in the direction of the arrows, the pad 58 is easily positioned at any desired location, with two of the many possible locations of the pad 58 being illustrated in FIGS. 7 and 8.

Figure 9:
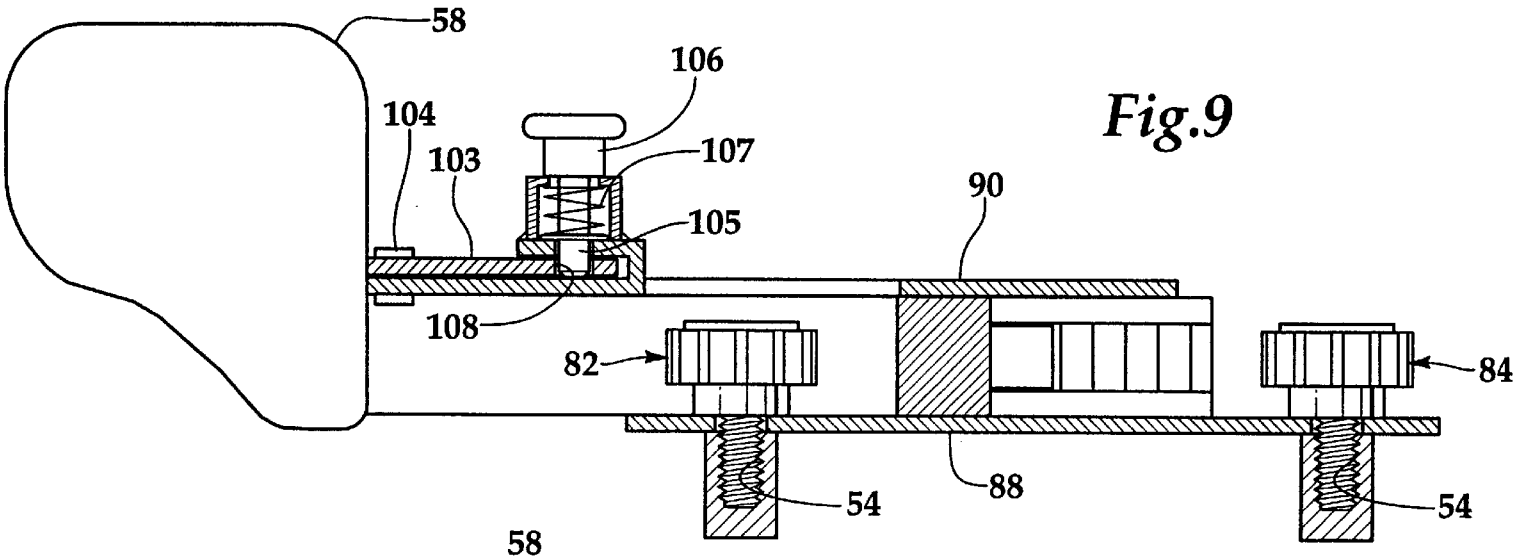
FIG. 9 is a sectional view illustrating the construction and operation of a spring loaded retaining pin useful in the practice of the invention.
Figure 10:
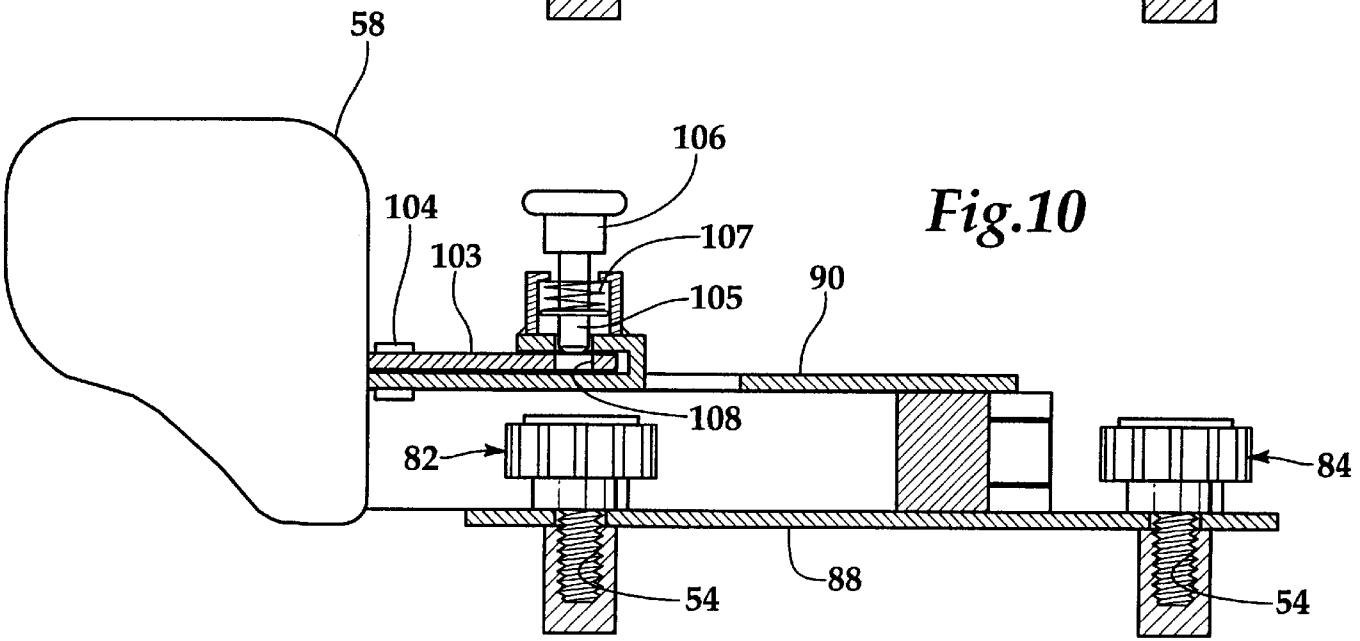
FIG. 10 is a view similar to FIG. 9 illustrating the component parts of the spring loaded retaining pin in a different configuration.
Figure 11:
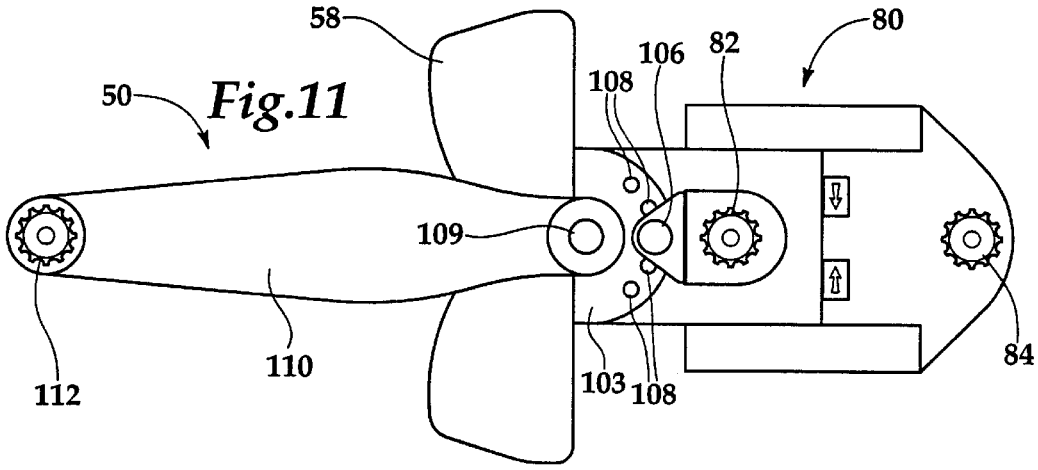
FIG. 11 is a top view of the front portion of the wakeboard mounting and retrieval system of the present invention showing the use of the retaining strap.
Figure 12:
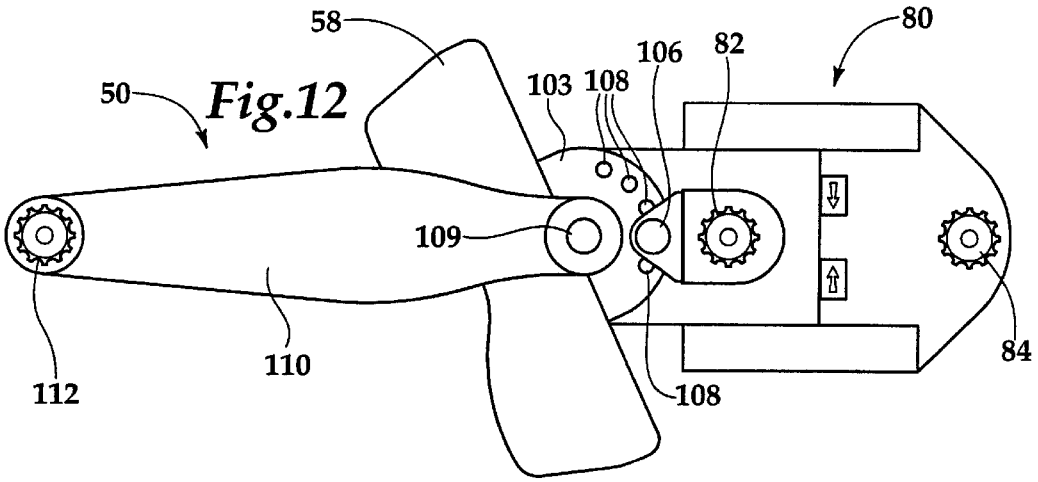
FIG. 12 is a view similar to FIG. 11 showing the component parts in a different configuration.

Referring to FIGS. 9 and 10, a plate 103 is pivotally supported on the bracket 90 by a pin 104. A detent 105 is mounted on the bracket 90 for actuation by a handle 106 to move upwardly and downwardly against and with the actuation of a spring 107. As is shown in FIGS. 11 and 12, the plate 103 has a plurality of apertures 108 formed therethrough. When the detent 105 is raised by actuation of the handle 106, the pad 58 and/or the pad 60 is pivotal about the axis of the pin 104 after which the handle 106 is released allowing the detent 105 to engage one of the apertures 108 to secure the pad 50 and/or 60 in place.

Figure 13:
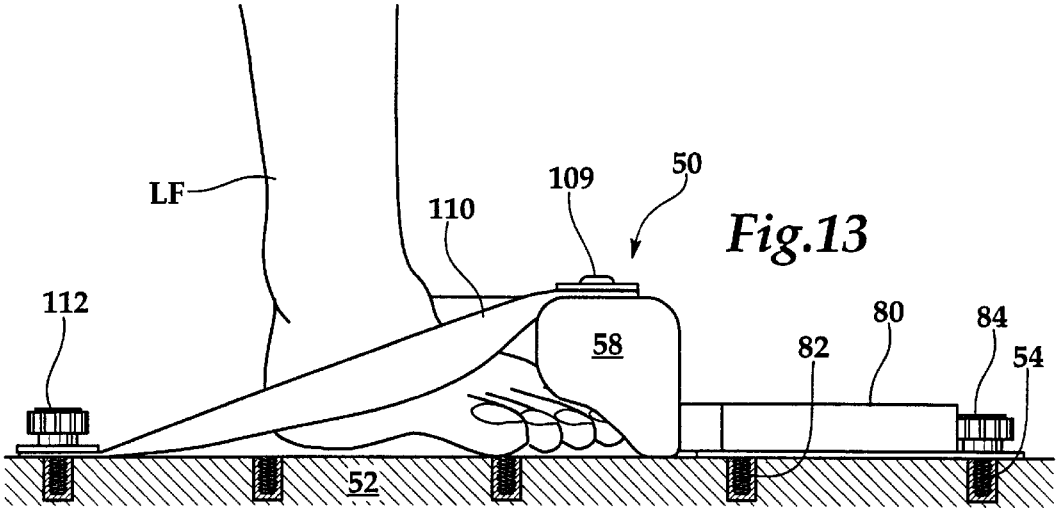
FIG. 13 is a further illustration of the use of the retaining strap.

Referring to FIGS. 11, 12, and 13, the wakeboard mounting and retrieving system 50 of the present invention may be provided with a strap 110. When used, the strap 110 is secured between an extension 109 of the pin 104 and a threaded fastener 112 which threadedly engages one of the threaded apertures 54 of the wakeboard 52.

The use of the strap 110 is illustrated in FIG. 13. When used, the strap 110 extends over the left foot LF of the wakeboarder which in turn extends under the pad 58. The purpose of the strap 110 is to prevent disengagement of the left foot LF from the pad 58 while the right foot of the wakeboarder is being engaged with the pad 60. Thus, in the preferred operation of the wakeboard mounting and retrieving system 50, the left foot LF of the wakeboarder is first positioned in engagement with the pad 58 and under the strap 110 which retains the left foot of the wakeboarder and in engagement with the strap 58 while the right foot of the wakeboarder is being engaged with the pad 60.

Figure 14:
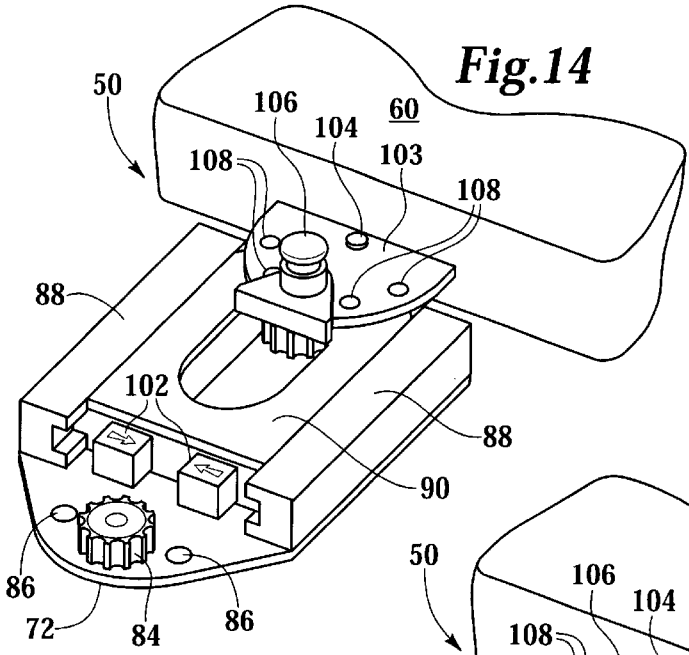
FIG. 14 is an enlarged perspective view of the rear portion of the wakeboard mounting and retrieval system of the present invention less the retrieval component thereof.
Figure 15:
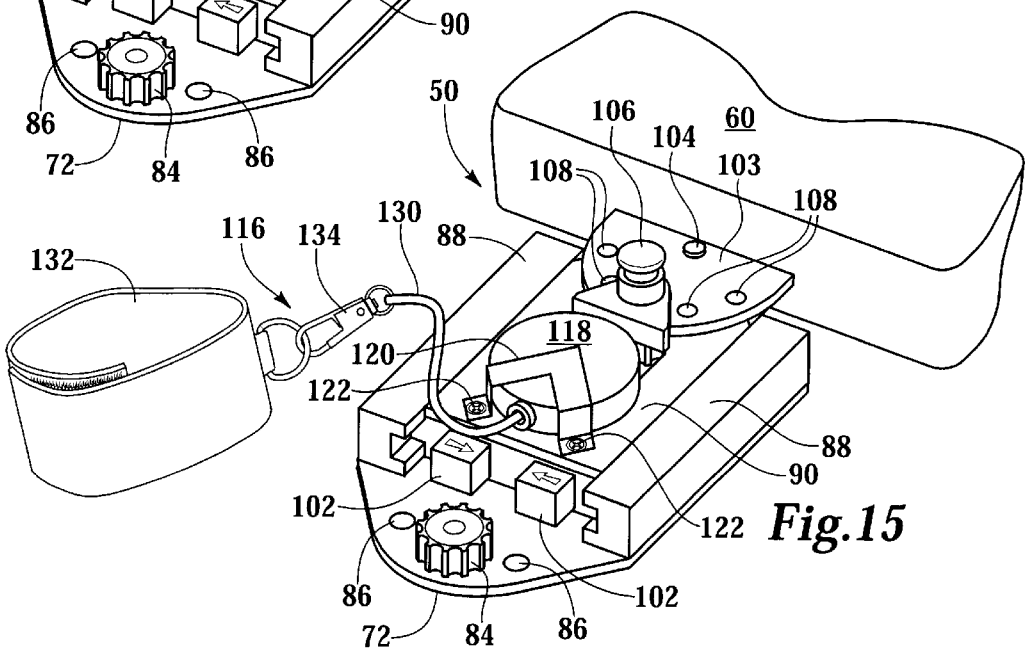
FIG. 15 is an enlarged perspective view of the rear portion of the wakeboard mounting and retrieval system of the present invention showing the retrieval component installed.

Referring to FIGS. 14 and 15, the retrieval component 116 of the wakeboard mounting and retrieval system 50 is shown in detail. A spring driven reel 118 is mounted on the sliding bracket 90 of the subframe 72 by a bracket 120 and fasteners 122. Although various types of spring driven reels may be utilized in the practice of the invention, the spring driven reel 118 may be of the type utilized in self-retrieving dog leads. A retrieval cable 130 extends from the spring driven reel 118 and is connected to an ankle strap 132 by a conventional fastener 134.

Referring momentarily to FIG. 4, the ankle strap 132 is wrapped around the right leg of the wakeboarder and is secured in place by conventional fastening apparatus, for example, a hook and loop-type fastener of the type sold under the trademark "VELCRO"®. Other conventional fastener arrangements may be utilized in conjunction with the ankle strap 122 is desired.

Figure 16:
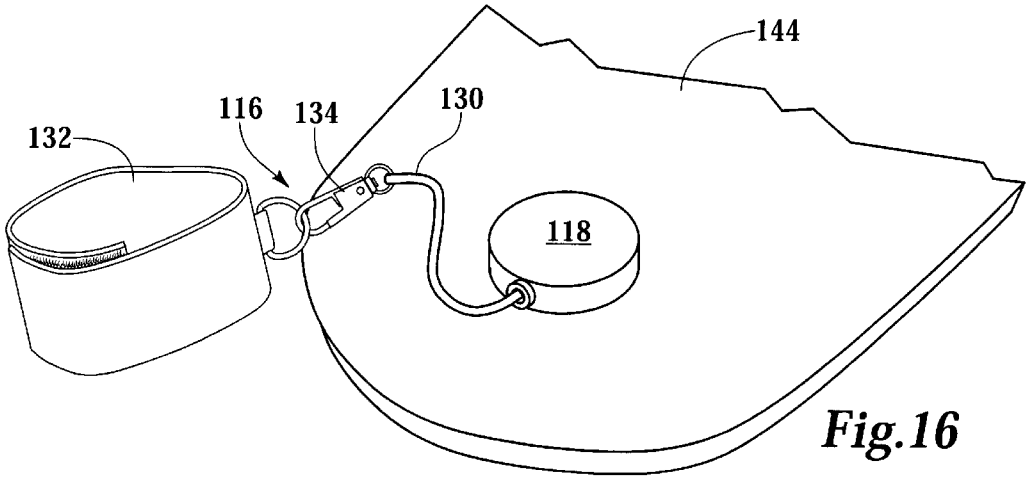
FIG. 16 is an illustration of the retrieval component of the wakeboard mounting and retrieval system of the present invention mounted on a surfboard.

Referring to FIG. 16, the retrieval component 116 of the present invention may be utilized in conjunction with apparatus other than wakeboards. In FIG. 16, the retrieval apparatus 116 is shown secured to surfboard 144, it being understood that the retrieval apparatus 116 may also be utilized in conjunction with a snowboard. The use of the retrieval apparatus 116 in conjunction with surfboards and/or snowboards is advantageous in that the retrieving cable 126 is retained in a retracted condition except in the event of a fall, whereupon the cable automatically extends. The cable 126 is thereafter used to retrieve the surfboard or snowboard thereby eliminating the possibility of loss.

Although preferred embodiments of the invention are illustrated in the accompanying Drawings and described in the foregoing Detailed Descriptions, it will be understood that the invention is not limited to the embodiments disclosed, but is capable of numerous rearrangements, modifications, and substitutions of parts and elements without departing from the spirit of the invention.

What is claimed is:

1. A wakeboard mounting system comprising:

opposed pads mounted on a wakeboard and configured to receive the feet of a wakeboarder thereunder;

each of said pads comprising a rigid frame, a layer of resilient material surrounding the frame, and a layer of water impervious material surrounding the resilient material and defining a surface curving upwardly and inwardly from the surface of a wakeboard for engaging the outward surface and a portion of the upper surface of one foot of a wakeboarder;

the opposed pads comprising mirror images of one another;

the opposed pads comprising the sole connection between the feet of the wakeboarder and the wakeboard upon which the pads are mounted; and apparatus mounting the opposed pads on a wakeboard and facilitating positioning of the opposed pads longitudinally and pivotally relative to the wakeboard.

2. The wakeboard mounting apparatus according to claim 1 further including a strap extending over one of the pads for facilitating engagement of a foot of the wakeboarder with the other pad.

3. The wakeboard mounting apparatus according to claim 1 wherein the wakeboard is provided with a plurality of threaded apertures, and wherein each of the pads is supported on a subframe which is secured to the wakeboard by a fastener threadedly engaged with one of the threaded apertures thereof.

4. The wakeboard mounting apparatus according to claim 3 wherein each of the subframes includes means for selectively positioning the pad longitudinally relative to the wakeboard.

5. The wakeboard mounting apparatus according to claim 3 wherein each of the subframes includes means for selectively positioning the pad pivotally relative to the wakeboard.

6. The wakeboard mounting apparatus according to claim 1 further including a retrieval cable secured to the wakeboard and a spring loaded reel for normally retracting the retrieval cable and for extending the retrieval cable upon disengagement of the wakeboarder from the wakeboard.

7. A wakeboard mounting system comprising:

opposed pads mounted on a wakeboard and configured to receive the feet of a wakeboarder thereunder;

apparatus mounting the opposed pads on a wakeboard and facilitating positioning of the opposed pads longitudinally and pivotally relative to the wakeboard;

the mounting apparatus for each of the opposed pads including a ratchet mechanism normally permitting movement of the pad in one longitudinal direction relative to the wakeboard while preventing movement of the pad in the opposite longitudinal direction and including a release mechanism selectively operable to facilitate movement of the pad in both longitudinal directions relative to the wakeboard;

the mounting apparatus for each pad further including a pivot pin supporting the pad for pivotal movement relative to the wakeboard and a detent mechanism selectively operable to secure the pad in a plurality of pivotal orientations relative to the wakeboard.

* * * * *